United States Patent [19]

Fujimoto et al.

[11] Patent Number: 4,872,831

[45] Date of Patent: Oct. 10, 1989

[54] KEROSENE HEATER PROVIDING AUTOMATIC WICK REPOSITIONING AFTER IGNITION

[75] Inventors: Masayuki Fujimoto, Nara; Muneo Tao, Yamatokoriyama; Kuniaki Uchida, Kashihara, all of Japan

[73] Assignee: Matsushita Electric Industrial Co., Ltd., Japan

[21] Appl. No.: 156,436

[22] Filed: Feb. 16, 1988

[30] Foreign Application Priority Data

Feb. 16, 1987 [JP] Japan ..... 62-33059

[51] Int. Cl.[4] ..... F23N 5/00

[52] U.S. Cl. ..... 431/73; 431/304; 431/317; 126/96

[58] Field of Search ..... 126/96; 431/34, 33, 431/76, 146, 304, 317, 73; 237/47, 1 R

[56] References Cited

U.S. PATENT DOCUMENTS 4,493,634 1/1985 Yang ..... 126/96

*Primary Examiner*—Henry A. Bennet

*Attorney, Agent, or Firm*—Lowe, Price, Leblanc, Becker & Shur

[57] ABSTRACT

A kerosene heater having a vertically oriented wick (4) which is movable to an upper position to be ignited, to a lowered position to be extinguished, and to any of a range of intermediate positions for continuous combustion, incorporates an apparatus (6A) operable by actuating a lever (6) to raise the wick to the upper position and initiate ignition and to lower the wick from that position, and an apparatus coupled thereto for automatically lowering the wick to a predetermined position within the combustion range after a predetermined time interval has elapsed following the start of igniting the wick. The danger of excessive flare-up of the wick flame after ignition is thereby eliminated, without the need for observation and control of the heater by the user.

12 Claims, 8 Drawing Sheets

FORWARD/REVERSE ROTATION PULSE GENERATING CKT
CONTROL SIGNAL GENERATING CKT
A
B
C
D
H1
H2
M

KEROSENE HEATER PROVIDING AUTOMATIC WICK REPOSITIONING AFTER IGNITION

BACKGROUND OF THE INVENTION

The present invention relates to a kerosene heater in which combustion is effected by means of a wick, and in which adjustment of the rate of combustion of the heater, as well as operations for igniting and extinguishing the wick, are executed by moving the wick upward or downward.

FIG. 1 shows the basic configuration of a prior art kerosene heater of this type. A manually operable lever 4*a* is coupled to a wick 4 by means of a pin 4*c*. Upward and downward movement of the lever 4*a* by the user thereby produces corresponding lowering and raising of the wick 4. Numeral 4*b* denotes a pivot about which the lever 4*a* is rotated, 1 denotes a fuel tank containing kerosene into which extends the lower end of the wick 4, 2 denotes a wick guidance pipe, 3 denotes a wick outer pipe, and 5 denotes a combustion pipe. With a prior art kerosene heater having the above configuration, if the wick 4 is raised to an upper position which is suitable for initiating igniting of the wick, is ignited, and is thereafter left in that upper position, then the flame produced from the wick will gradually increase in size and may eventually extend to the upper end of the combustion tube 5, i.e. may flare up excessively. It is therefore necessary for the user, after having initiated lighting of the wick, to thereafter observe the condition of the wick during a certain amount of time until the wick is fully ignited (i.e. until a flame extends around the entire periphery of the upper end of the wick). The user must then actuate the lever 4*a* to lower the wick by an appropriate amount, to thereby reduce the rate of combustion to a suitable level for continuous operation of the heater.

The necessity for thus observing and controlling the heater after ignition has been initiated renders the use of such a prior art kerosene heater rather inconvenient. Furthermore if the wick is left at the upper position (i.e. the upper position at which ignition of the wick can be executed) after lighting has been performed, then even if the wick flame does not flare up excessively, the rate of combustion will generally be such that the temperature in the room in which the kerosene heater is being used may thereafter become excessively high, making it necessary for the user in any case to actuate the lever 4*a* to reduce the combustion rate. The overall level of fuel consumption of such a kerosene heater will therefore be unnecessarily high, unless the user carefully controls the operation of igniting the wick.

For the above reasons, a prior art type of kerosene heater utilizing a wick is inconvenient to use, must be carefully operated to ensure safety during lighting of the wick, and may have excessively high fuel consumption during the wick igniting process.

SUMMARY OF THE INVENTION

It is an objective of the present invention to provide a kerosene heater which overcomes the problems of the prior art described above. More specifically, it is an objective of the present invention to provide a kerosene heater whereby if the wick of the heater is set at an upper position in which lighting of the wick initiated, and is thereafter left by the user at that upper position, subsequent flare-up of the wick flame or unnecessary fuel consumption will be automatically prevented.

In order to achieve the above objective, a kerosene heater according to the present invention comprises a wick raising and lowering apparatus for executing vertical displacement of the wick, having coupled thereto a fuel consumption saving apparatus functioning to automatically lower the wick to a predetermined position that is suitable for continuous combustion, after lighting of the wick has been completed, and to hold the wick at that position.

Due to this configuration of a kerosene heater according to the present invention, if the wick is raised to the aforementioned upper position thereof (i.e. which is suitable for initiating igniting of the wick) and is thereafter left at that position, the wick will be subsequently automatically lowered to a predetermined position and retained at that position, whereby the rate of combustion of the heater is reduced to a predetermined value which has been set by the user. It is therefore unnecessary for the user to perform adjustment of the rate of combustion by adjusting the wick position, after igniting of the wick has been completed, to prevent flare-up of the wick flame. Thus, such a kerosene heater provides substantially improved ease of use, greater safety of operation, and reduced danger of excessive fuel consumption.

More specifically, a kerosene heater according to the present invention comprises:

a wick which is movable upward and downward and which can be ignited when raised to an upper position and can be extinguished by being lowered to a lower position;

a wick raising and lowering apparatus for executing upward and downward movement of said wick; and fuel consumption saving means for automatically lowering the wick from said upper position to a predetermined position which is within a range of combustion positions of said wick.

DESCRIPTION OF THE PREFERRED EMBODIMENTS

Figure 2:
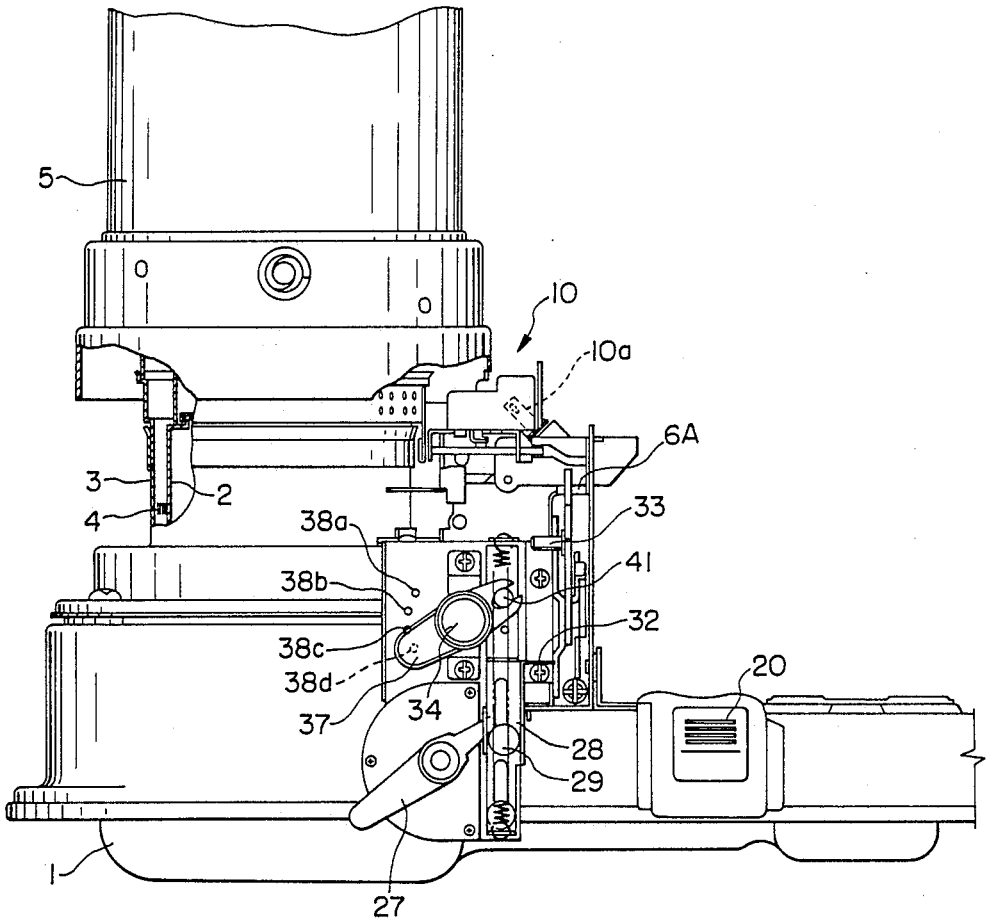
FIG. 2 is a view in elevation of a first embodiment of a kerosene heater according to the present invention showing the condition of the kerosene heater prior to igniting the wick.
Figure 3:
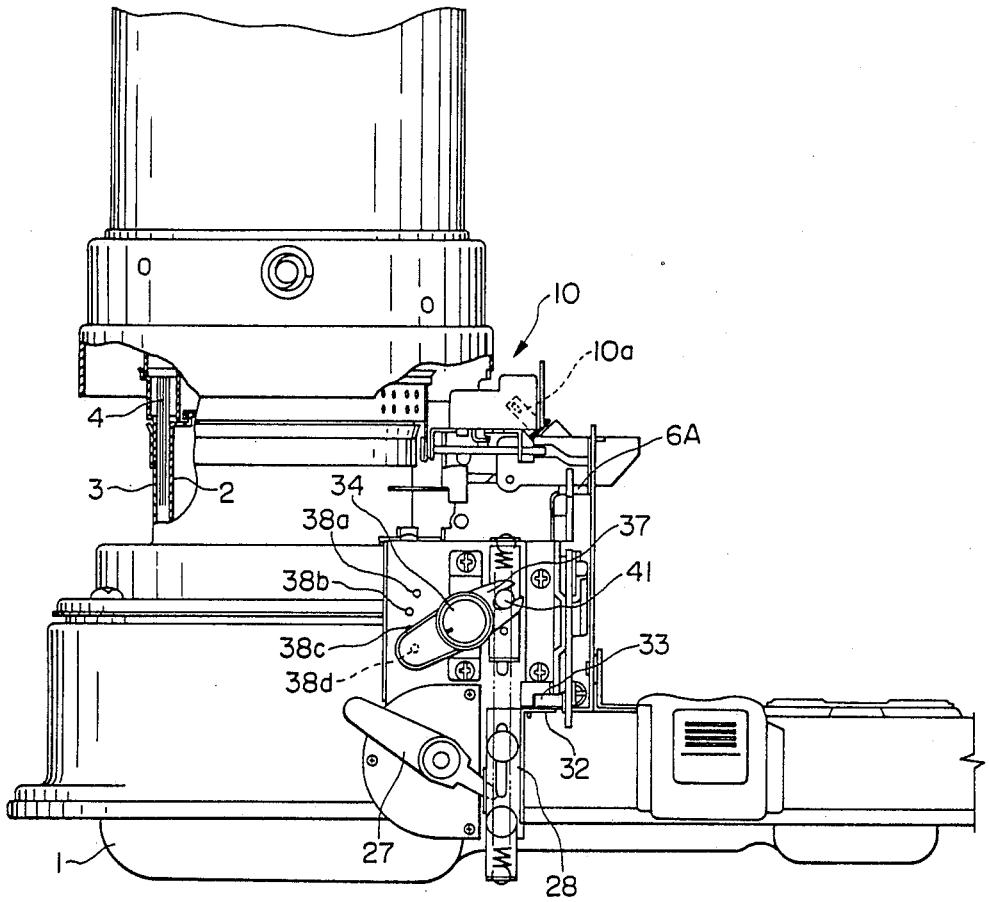
FIG. 3 is a view in elevation of the first embodiment showing the condition of the kerosene heater during igniting of the wick.
Figure 4:
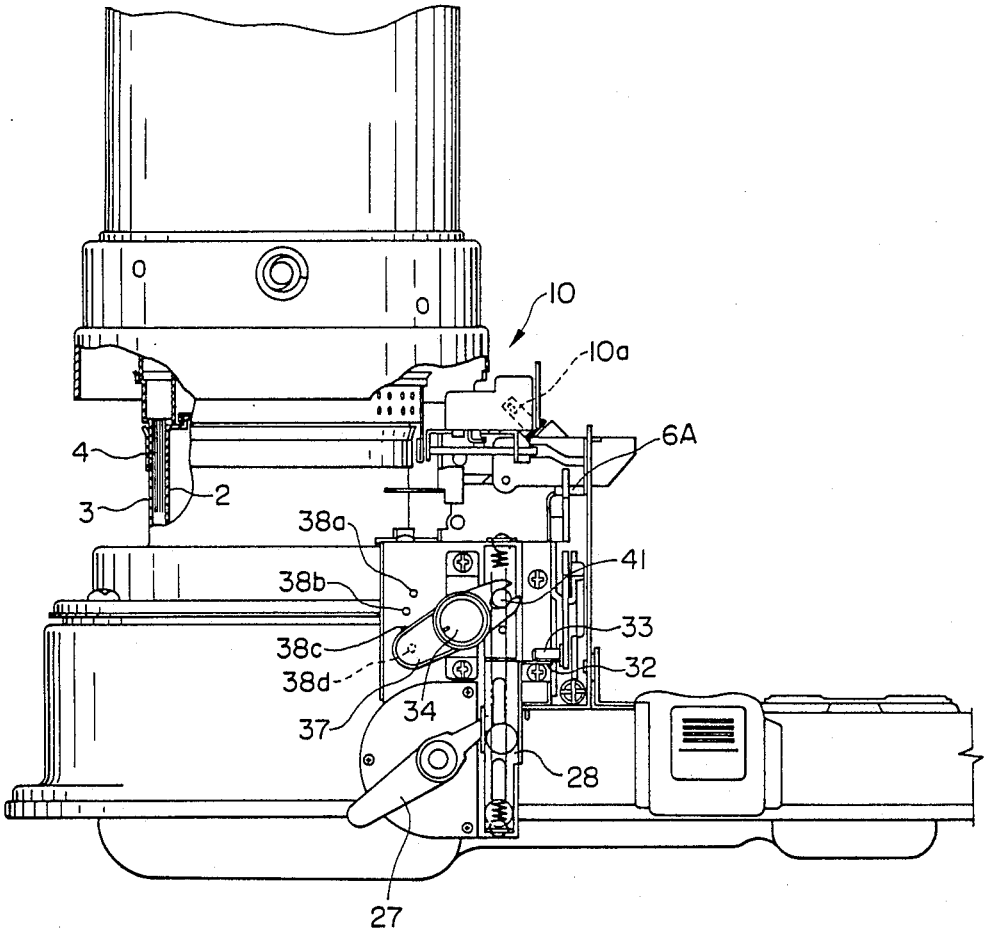
FIG. 4 is a view in elevation of the first embodiment showing the condition of the kerosene heater when operating in a continuous combustion status.

A first embodiment of a kerosene heater according to the present invention will be described referring to FIGS. 2 through 4, in which as for the prior art example described above, numeral 1 denotes a fuel tank having a wick guidance pipe 2 fixedly mounted thereon extending vertically and numeral 3 denotes a wick external pipe which is disposed around the outer periphery of the wick guidance pipe 2 with a gap being formed between the outer periphery of pipe 2 and the inner periphery of pipe 3. Numeral 4 denotes a wick whose lower end end extends into the fuel tank 1 and which is movable upward or downward within the gap between pipes 2 and 3, while combustion of fuel from the wick 4 take place within a combustion pipe 5.

Figure 9:
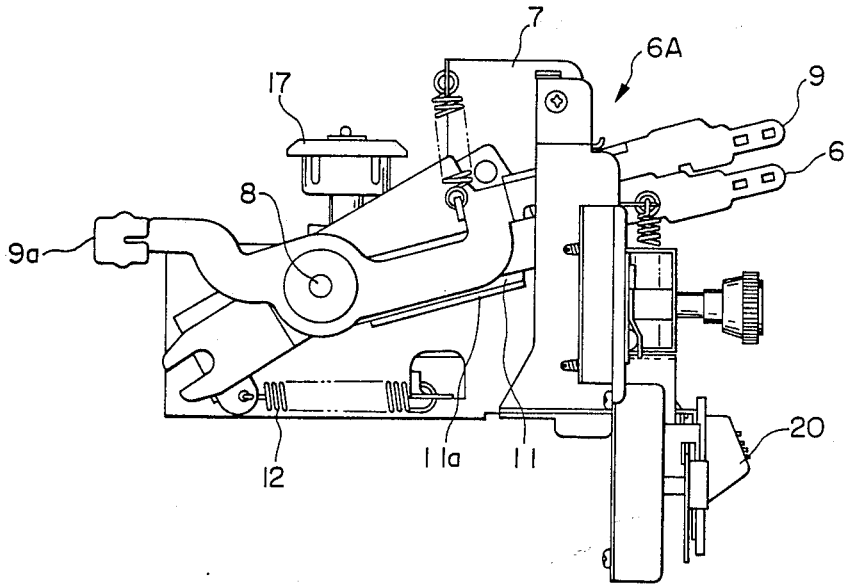
FIG. 9 is a side view of a wick raising and lowering apparatus of the first embodiment, in the condition prior to igniting of the wick.
Figure 10:
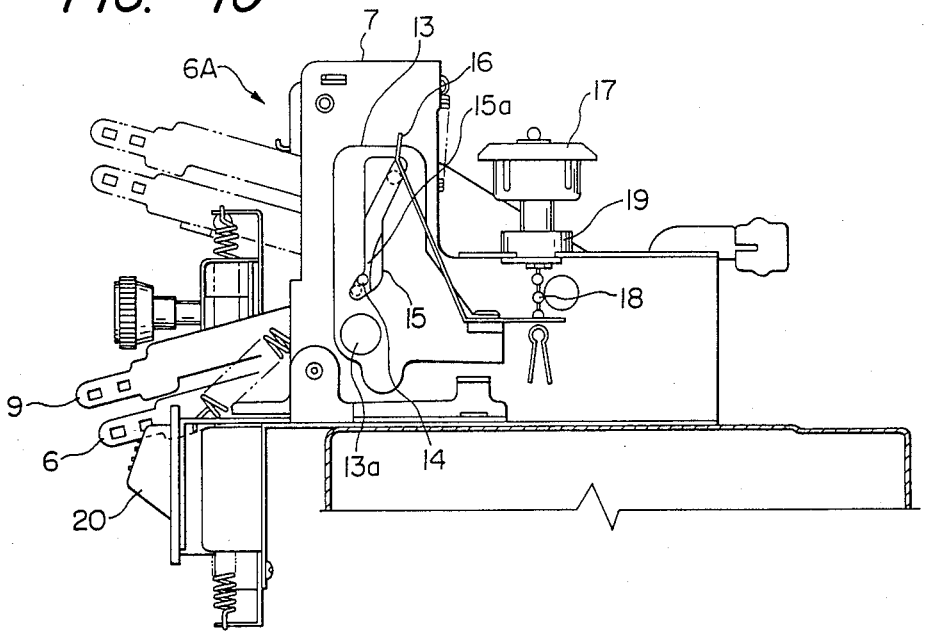
FIG. 10 is a side view to illustrate the condition of the wick raising and lowering apparatus of FIG. 9 after igniting of the wick has been performed, viewed from the opposite side from that of FIG. 9.

FIGS. 9 and 10 show the configuration of a wick raising and lowering apparatus 6A utilized to raise and lower the wick 4. Numeral 6 denotes a wick raising and lowering lever which can be actuated to raise and lower the wick 4 and has one end thereof coupled through suitable coupling means to the wick 4. The wick raising and lowering lever 6 is pivoted for rotation about a pin 8 which is mounted on a wick raising and lowering baseplate 7, which is attached to the fuel tank 1. Numeral 9 denotes an igniting lever which is pivoted on the wick raising and lowering baseplate 7 by means of the pin 8, together with the wick raising and lowering lever 6. One end 9*a* of the igniting lever 9 is coupled to actuate a heater 10A of an igniting apparatus 10 (shown in FIGS. 2 to 4), which is operable to ignite the wick 4. After igniting of the wick 4 has occurred, the igniting lever 9 is automatically returned to its original position.

The wick raising and lowering apparatus 6A basically consists of the wick raising and lowering lever 6 and the igniting lever 9. However the present embodiment also incorporates an apparatus for automatically extinguishing the kerosene heater by rapidly lowering the wick, in the event of movement of the kerosene heater being produced for example by an earthquake, as described in the following. Numeral 11 denotes a wick raising and lowering member which is pivoted on the wick raising and lowering baseplate 7 by means of the pin 8, together with the wick raising and lowering lever 6 and the igniting lever 9. The wick raising and lowering member 11 is coupled to the wick raising and lowering lever 6 by means of a coupling arm 11*a*, which is curved such as to be set in contact with the wick raising and lowering lever 6 when lever 6 is set to a lowered position. Numeral 12 denotes a spring for urging the wick raising and lowering member 11 towards an upper position thereof (i.e. corresponding to a lowered position of the wick 4), which is connected between one end of the wick raising and lowering member 11 and the wick raising and lowering baseplate 7. Numeral 13 denotes a lock plate, for retaining the wick raising and lowering member 11 at a lowered position thereof (i.e. corresponding to an upper position of the wick 4), which is pivoted to be freely rotatable by means of a pin 13*a*. The lock plate 13 is formed with an elongated aperture 15 therein, into which protrudes a pin 14 which is mounted on the wick raising and lowering member 11. The rear end of this elongated aperture 15 is formed with a stopper portion 15*a*, against which the pin 14 abuts to halt further movement of the pin 14. In this way when the wick raising and lowering lever 6 is moved downward, to thereby raise the wick, the wick raising and lowering member 11 is swung downward by means of a force which acts through the coupling arm 11*a*. When pin 14 of the wick raising and lowering member 11 is moved downward along the elongated aperture 15, and reaches the rear end of aperture 15, then pin 14 engages with the stopper portion 15*a* whereby irrespective of the urging force which is produced by the spring 12, the wick raising and lowering member 11 becomes locked in position. Numeral 16 denotes a leaf spring which is attached to the lock plate 13. Numeral 17 denotes a weight which is coupled to the leaf spring 16 through a chain 18, and is used to extinguish the kerosene heater in the event of accidental movement, e.g. due to an earthquake, etc. The weight 17 is supported on a cradle 19 which is attached to the wick raising and lowering baseplate 7. When an earthquake occurs of sufficient magnitude that the weight 17 is displaced and falls, a force is thereby applied through the chain 18 which acts to bend the leaf spring 16 and hence rotate the lock plate 13. As a result, the pin 14 will moved out of the stopper portion 15*a* of the elongated aperture 15 whereby the wick raising and lowering member 11 will be swung upward due to the urging force produced by the spring 12. When this occurs, the coupling arm 11*a* of the wick raising and lowering member 11 acts to swing the wick raising and lowering lever 6 upward, whereby the wick 4 is lowered and hence is extinguished. The pin 14, which has been returned to its uppermost position, presses against the leaf spring 16, and the weight 17 which had fallen and is suspended by the chain 18 is returned to its original position.

Numeral 20 denotes an emergency extinguishing pushbutton, which can be actuated by the user to operate the lock plate 13 in the same way as does movement of the weight 17, as described above, for thereby rapidly extinguishing the wick flame when necessary.

Figure 6:
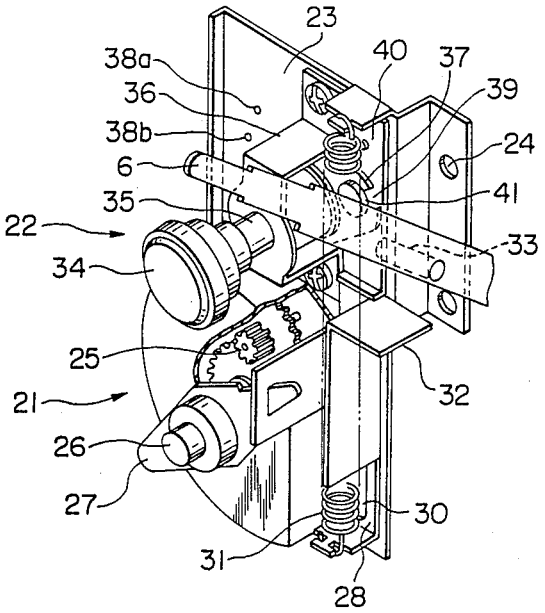
FIG. 6 is an oblique view of essential components of the first embodiment showing the condition prior to igniting the wick.
Figure 7:
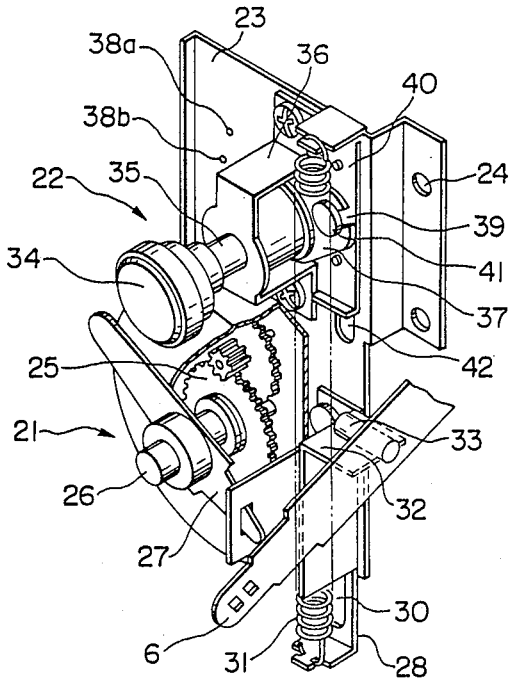
FIG. 7 is an oblique view of essential components of the first embodiment showing the condition following igniting of the wick.

FIGS. 6 and 7 show a fuel consumption saving apparatus 21, which is linked to the aforementioned wick raising and lowering apparatus, and also show a combustion rate selection apparatus 22 which can be set by the user to establish a position of the fuel consumption saving apparatus 21 which determines the rate of combustion of the kerosene heater during continuous combustion operation. The fuel consumption saving apparatus 21 functions to gradually lower the wick from an upper position, when ignition of the wick has been initiated, to a preset position (determined by the combustion rate selection apparatus 22 as described hereinafter) at which normal continuous combustion occurs. The speed at which the wick is lowered automatically in this way at the time of ignition is determined such as to minimize the amount of fuel consumed during each ignition operation, while also ensuring that complete ignition of the entire periphery of the wick is established.

The configurations of the fuel consumption saving apparatus 21 and combustion rate selection apparatus 22 will be described in the following. Numeral 23 denotes a baseplate having both the fuel consumption saving apparatus 21 and the combustion rate selection apparatus 22 mounted thereon, which is attached to the wick raising and lowering baseplate 7 by means of a screw passing through a through-hole 24.

Figure 8:
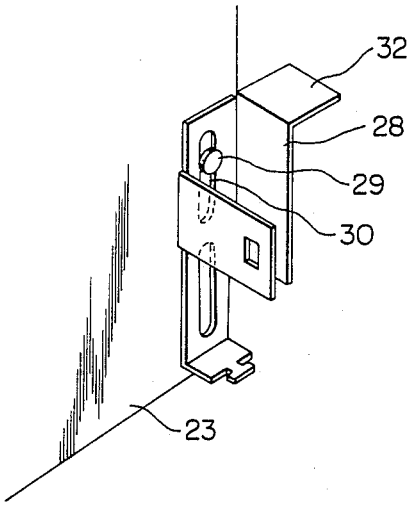
FIG. 8 is an oblique view of an operating arm of the first embodiment.

Numeral 25 denotes a set of reduction gears which are mounted on the baseplate 23, with a rotary shaft 26 of these gears being fixedly attached to a lever 27. An operating arm 28 is linked to the lever 27, and is formed in the shape shown in FIG. 8. The operating arm 28 is freely movable upward or downward with respect to the baseplate 23, by means of a pin 29 which is attached to the baseplate 23 and engages within a slot aperture 30. A coil spring 31 is coupled between the operating arm 28 and the baseplate 23, and serves to urge the operating arm 28 to an upper position thereof as shown in FIG. 6. A pin contact portion 32 is formed on a part of the operating arm 28, to receive an operating pin 33 that is mounted on the wick raising and lowering lever 6. In this way, movement of the operating arm 28 is linked to that of the wick raising and lowering lever 6. Thus, when the wick raising and lowering lever 6 is pressed downward so as to move the wick upward, the operating pin 33 acts on the pin contact portion 32 such as to push the operating arm 28 downward as shown in FIG. 7. As a result of the urging force produced by the coil spring 31 and the speed reduction which is effected by the reduction gear train 25, the operating arm 28 gradually rises, and thereby acts through the pin contact section 32 and the operating pin 33 to push the wick raising and lowering lever 6 upward (i.e. thereby lowering the wick 4). In this way the reduction gear train 25, the lever 27, the operating arm 28 and the coil spring 31 etc., constitute in combination the fuel consumption saving apparatus 21.

Numeral 34 denotes a fuel combustion rate adjustment knob, fixed to a shaft 35 which is rotatably mounted on the baseplate 23 by a mounting member 36. Numeral 37 denotes a selection lever which is fixed to the shaft 35 of the fuel combustion rate adjustment knob 34, with one end of the selection lever 37 having a projecting portion (not shown in the drawings) formed thereon at one end for engaging in one of a plurality of through-holes 38*a*, 38*b*, 38*c* and 38*c* which are formed in the baseplate 23, as shown in FIGS. 2 through 4. This projecting portion of the selection lever 37 can thereby be fixedly engaged at a position defined by one of these apertures 38*a* to 38*c*. An open slot 39 is cut out of the opposite end of the selection lever 37 from that having the aformentioned projecting portion. A selection plate 40 is positioned opposite the operating arm 28 of the fuel consumption saving apparatus 21, with a pin 41 being fixedly mounted on an intermediate portion of the selection plate 40, which engages in a slot aperture 42 in the baseplate 23, and also engages in the open slot 39 formed in the selection lever 37. In this way when the fuel combustion rate adjustment knob 34 is rotated, the selection plate 40 is moved upward or downward by the action of the selection lever 37. Thus, the fuel combustion rate adjustment knob 34, the selection lever 37, and the selection plate 40 etc., constitute in combination the combustion rate setting apparatus 22.

The operation of this kerosene heater embodiment is as follows. Firstly, the operation resulting from pressing the wick raising and lowering lever 6 (together with the igniting lever 9) downward from the condition shown in FIGS. 2, 6 and 9 will be described. When this downward movement occurs, the wick 4 is raised to the ignition position while in addition the igniting lever 9 acts to set in operation the heater 10*a* of the igniting apparatus 10, to thereby light the wick 4. The igniting lever 9 then returns to its original position, and the heater 10*a* is restored to its original operation condition, whereby the combustion status shown in FIGS. 3, 7 and 10 is entered.

During this operation of raising the wick 4 by pressing the wick raising and lowering lever 6 downward, the operating pin 33 mounted on the wick raising and lowering lever 6 presses downward the operating arm 28 (acting through the pin contact portion 32), while in conjunction with this lowering of the operating arm 28, the reduction gear train 25 is rotated by the lever 27. As a result of the lowering of the operating arm 28, the coil spring 31 (which was in the expanded condition) begins to apply a restoring force to the operating arm 28.

Figure 1:
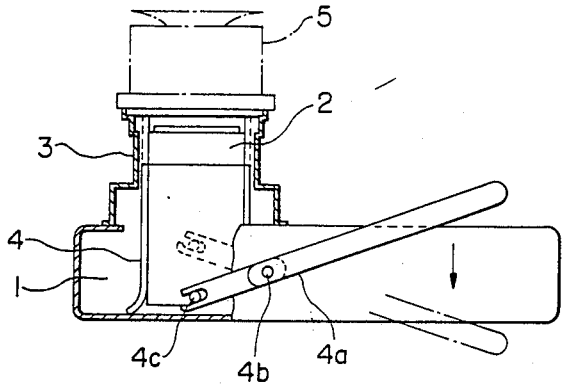
FIG. 1 PRIOR ART
FIG. 1 is a cross-sectional view in elevation of a prior art kerosene heater.
Figure 5:
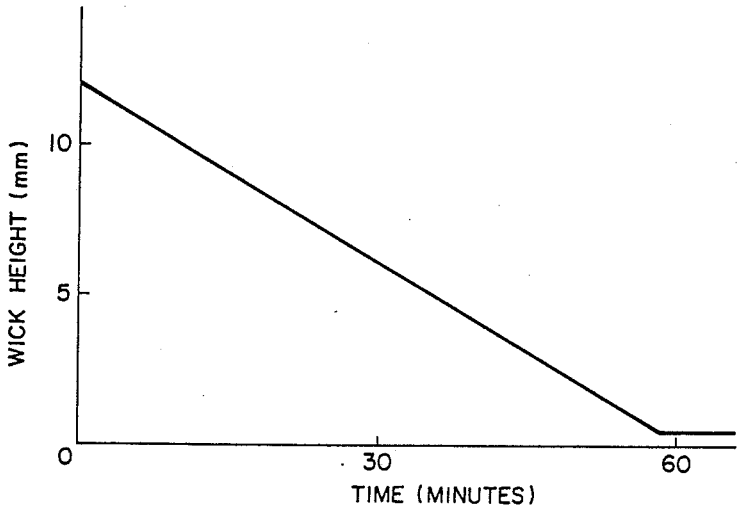
FIG. 5 is a graph showing a relationship between wick height and elapsed time after ignition has been initiated with the first embodiment, whereby fuel consumption saving is achieved.

The above operations complete the process of igniting the wick. However with this kerosene heater embodiment, as described in the above, at the time of completion of igniting the wick the operating arm 28 (which had been in the lowered position thereof) begins to be gradually raised due to the urging force exerted by the coil spring 31 acting through the reduction gear train 25, due to the speed reduction effect produced by the gears 25. The operating arm 28 thereafter acts through the pin contact portion 32 to push upward the operating pin 33, and hence push upward the wick raising and lowering lever 6. As a result, the wick 4 becomes gradually lowered, with the rate of change of position of the wick being as illustrated by the graph of FIG. 5. In this way, when the wick is ignited, an automatic fuel saving operation is initiated in order to gradually reduce the rate of combustion. The speed at which this reduction of the combustion level is performed can be freely determined by selection of the speed reduction ratio produced by the reduction gear train 25.

As the operating arm 28 is raised in order to reduce the fuel combustion rate as described above, the operating arm 28 gradually approaches the selection plate 40 of the combustion rate selection apparatus 22, and eventually comes into contact with the plate 40 to be halted thereby. In this way, further upward movement of the operating arm 28 is terminated, so that the fuel consumption rate is held at a value which is determined by the position of the operating arm 28, which is established by the selection plate 40, with the wick 4 having been thereby lowered to a position within a combustion range, i.e. a range of positions at which stable continuous combustion can take place. Thereafter, combustion continues at the fuel consumption rate which has thus been set. The position at which the operating arm 28 is halted can be varied by varying the selection position of the selection plate 40. In the described embodiment, the position of the selection plate 40 can be selected in four stages, by rotation of the fuel consumption rate adjustment knob 34. Specifically, the selection lever 37 is rotated as a result of rotation of the fuel consumption rate adjustment knob 34, whereby a force is applied to the open slot 39 by the pin 41, so that the selection plate 40 is displaced upward or downward. This movement is halted when the protrusion portion of the selection lever 37 (described hereinabove) engages in one of the through-holes 38*a*, 38*b*, 38*c* or 38*d* of the baseplate 23. The position at which the operating arm 28 is halted is thereby defined.

It should be understood that with the embodiment of a kerosene heater described above, the fuel consumption rate is automatically reduced after the wick has been ignited, and that combustion thereafter takes place at a rate which is determined by a fuel combustion rate position that has been set by the user, by means of the selection plate 40. However the kerosene heater is also arranged such that, after the wick 4 has been raised by the wick raising and lowering lever 6, the wick raising and lowering lever 6 can be actuated by the user irrespective of the fuel consumption saving apparatus 21. That is to say, the operation of the wick raising and lowering lever 6 is not held in a linked relationship with that of the fuel consumption saving apparatus 21, so that lever 6 can be freely actuated at any time, in order to lower and hence extinguish the wick 4.

In addition, irrespective of the automatic fuel consumption saving operation, the fuel consumption rate can be reduced by the user at any time after the wick has been ignited. Specifically, as described in the above, a combustion rate setting apparatus 22 is incorporated in the embodiment. By setting the selection position thereof to the maximum combustion rate position (i.e. to provide no reduction of the combustion rate), the combustion rate can be freely reduced by the user irrespective of the fuel consumption saving apparatus 21. In this way, such a kerosene heater can be utilized in exactly the same manner as a conventional kerosene heater if so desired.

Figure 11:
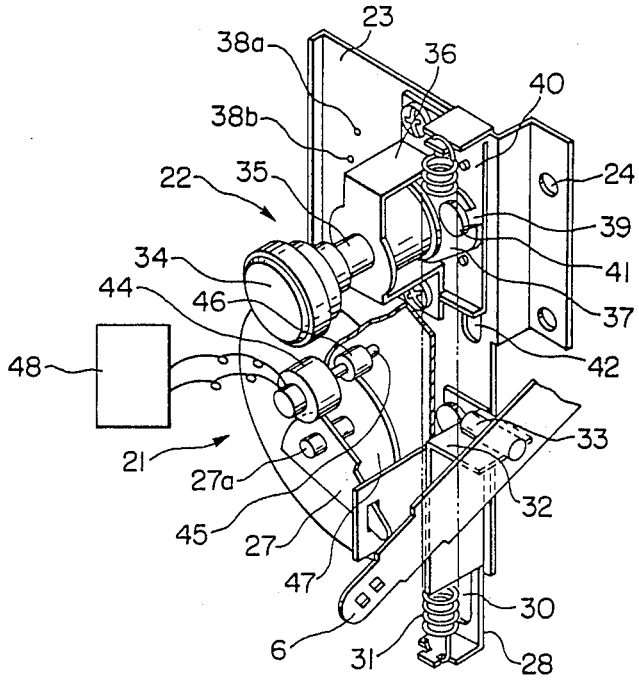
FIG. 11 is an oblique view showing essential portions of a fuel consumption saving apparatus of a second embodiment of a kerosene heater according to the present invention; and, FIG. 12 is a circuit diagram of a control circuit for the fuel consumption saving apparatus of FIG. 11.
Figure 12:
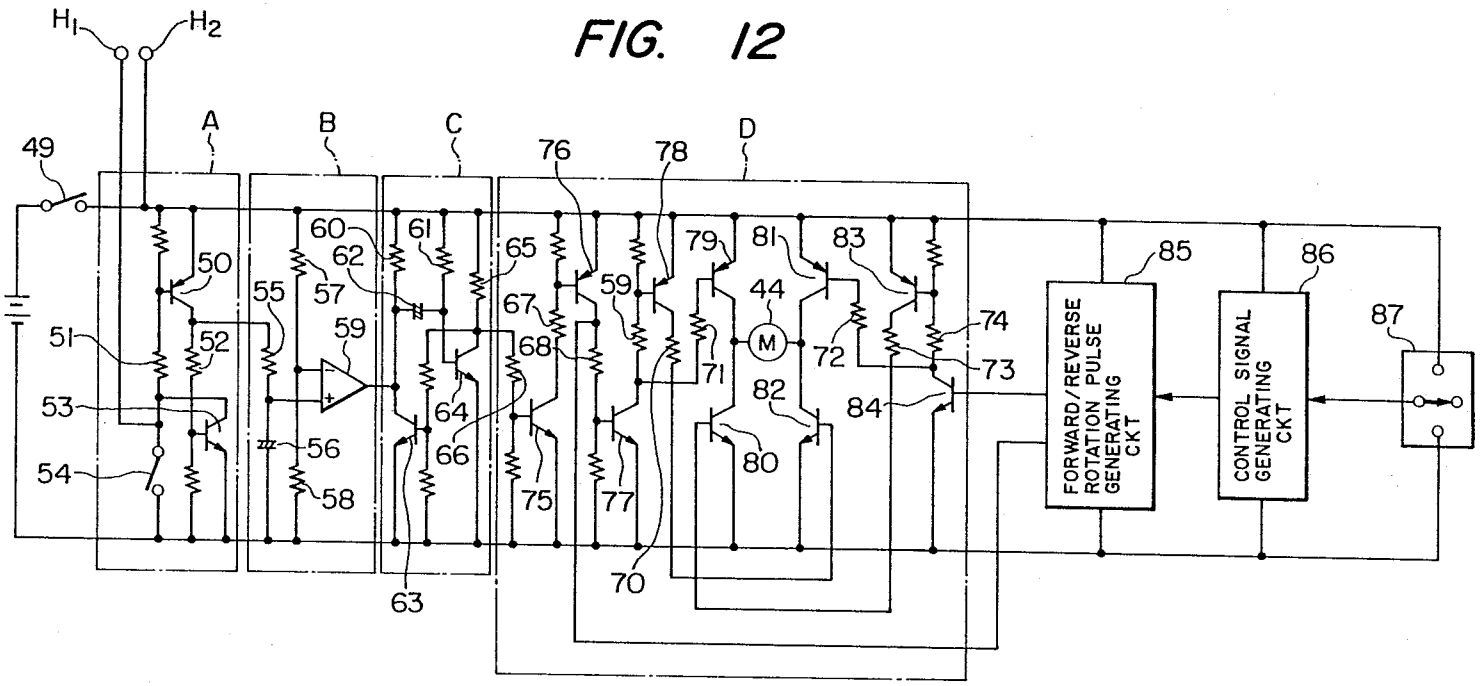

FIGS. 11 and 12 show an example of the fuel consumption saving apparatus 21 for a second embodiment of a kerosene heater according to the present invention. Components corresponding to those in the embodiment described hereinabove are designated by corresponding reference numerals, and further description will be omitted. Numeral 44 denotes an electrical drive device, which in this embodiment is a motor, having a drive shaft 45 on which is fixedly mounted a friction wheel 46. A Vertical friction wheel 47 is driven by the motor 44 through the friction wheel 46, and is fixedly mounted on a shaft 27*a* of the lever 27 which is coupled to the operating arm 28. The operating arm 28 can thereby be driven, i.e. moved upward or downward, depending upon the direction of rotation of the motor 44. The friction wheel 46 and vertical friction wheel 47 are held in mutual contact with an appropriate degree of pressure being applied between them, such that when the wick raising and lowering lever 6 is pushed upward, the vertical friction wheel 47 is rotated relative to the friction wheel 46. Thus in this condition the friction wheels 46 and 47 are effectively mutually uncoupled. A control circuit 48 controls the rotation of the motor 44 as described hereinafter.

FIG. 11 shows a circuit diagram of the control circuit 48. In FIG. 11, numeral 49 denotes an operating switch, 50 and 53 denote transistors, 51 and 52 denote resistors, and 54 denotes an igniting switch. The heater 10*a* of the igniting apparatus 10 is connected between terminals $H_1$ and $H_2$. When the wick raising and lowering lever 6 is actuated by the user to raise the wick 4 to the upper position at which ignition can be executed (with the operating switch 49 in the closed, i.e. ON state), the switch 54 is thereby set in the closed state whereby power is supplied to the heater 10*a*, to initiate igniting of the wick 4. The above components 50 to 54 are connected to form an ignition sensing circuit A. When it is sensed by this circuit that igniting of the wick has taken place, this sensing circuit A thereafter remains in a condition indicating that the wick has been ignited until the operating switch 49 is subsequently opened, i.e. is set in the OFF state, i.e. the "wick ignited" status is memorized by this circuit and indicated by an output signal produced from the collector of transistor 50.

Numerals 55, 57 and 58 denote resistors, 56 a capacitor, and 59 a comparator. These components 55 to 59 are connected to form a timer circuit B.

Numerals 61 and 65 denote resistors, 62 a capacitor, and 63, 64 transistors. The components 61 to 64 are connected to form a 1-shot multivibrator C, which responds to an output signal $L_O$ from the timer circuit B to produce a pulse signal of fixed width.

Numerals 66 to 74 denote resistors, 75 to 84 transistors, which are connected to form a forward/reverse drive circuit D for the motor 44. While an output pulse is being produced from the 1-shot multivibrator C, the forward/reverse drive circuit D functions to drive the motor 44 for rotation in the reverse direction. A forward/reverse rotation pulse generating circuit 85 is coupled to receive control signals produced from a control signal generating circuit 86 in response to actuations of a control switch 87 by the user. In this by actuating the switch 87, the user can execute upward or downward displacement of the wick 4, to vary the fuel consumption rate as required.

The operation of this embodiment is as follows. Igniting of the wick is executed in a similar manner to that described for the first embodiment described above, i.e. by the user swinging downward the wick raising and lowering lever 6 of the 6A, whereby the igniting lever 9 is pushed to a lowered position. The operating switch 49 is thereby closed, to set the control circuit 48 in the operating status. At the same time, the ignition switch 54 is closed, whereby transistor 50 is set in the conducting state, as also is transistor 53. Due to this conducting condition of transistor 53, a latched condition is established whereby when the ignition switch 54 is thereafter returned to the open state, the transistor 50 is held in the conducting state to indicate that the wick 4 has been ignited, i.e. the "wick ignited" status is memorized. After a sufficient time interval has elapsed to initiate ignition of the wick, the switch 54 is opened to halt the supply of current to the heater 10*a*. At this time, current flow through the heater 10*a* passing through the transistor 53 is also interrupted. However for brevity of description, the means for executing the latter interruption are omitted from the drawing.

Due to the conducting condition of transistor 50, current begins to flow through resistor 55 into the timer capacitor 56. When the voltage to which capacitor 56 becomes charged reaches a predetermined threshold valve (determined by the values of resistors 57 and 58), the comparator 59 produces an output signal $L_O$. The timer circuit B functions as a delay timer which defines a time interval following the start of a wick ignition operation, which must elapse before the entire periphery of the wick has become ignited. The 1-shot multivibrator C is then triggered by this output signal $L_O$, i.e. the transistor 64 is set in the non-conducting state during a time interval which is determined by the values of resistor 61 and capacitor 62. A pulse signal is thereby supplied through the resistor 65 to the motor drive circuit D, whereby the transistors 65 to 68 are set in the conducting state, and hence the motor drive transistors 79 and 82 are each set in the conducting state, so that a voltage is applied to the motor 44 which produces motor rotation in the reverse direction to thereby effect lowering of the wick 4. This reverse rotation continues for the duration of the pulse from the 1-shot multivibrator C. As a result, the wick 4 is moved by the wick raising and lowering apparatus from an initial position (i.e. the upper position, at which ignition is executed) downward to a height which provides optimum combustion. Combustion thereafter continues with the wick held at that position.

The above operations can be cancelled at any time by executing an extinguishing operation. Specifically, the operating switch 49 is also manually operable, so that the user can set switch 49 to the open state, and then raise the wick raising and lowering lever 6 to its original position to thereby extinguish the wick. If a re-ignition operation is then initiated by moving the lever 6 downward, the sequence of operations described above will be repeated.

It should be noted that the present invention is not limited to the embodiments described above, and that various modifications to these may be envisaged. For example, the control circuit functions could be implemented by a suitably programmed microcomputer.

As will be clear from the embodiments described above, with a kerosene heater according to the present invention, the wick of the heater is automatically lowered by a predetermined amount, to a suitable position for continuous combustion, after a fixed time interval has elapsed following the initiation of igniting the wick. Fuel consumption is thereby economized, while in addition a condition of excessive flame size due to flare-up of the wick flame following ignition is effectively prevented from occurring, without the necessity for the user to observe and control the heater at that time. Such a kerosene heater therefore provides substantially improved safety and convenience of use by comparison with a conventional type of kerosene heater, together with reduced fuel consumption.

What is claimed is:

1. A kerosene heater comprising:

a wick which is movable upward and downward and which can be ignited when raised to an upper position and is extinguished when moved to a lowered position;

a wick raising and lowering apparatus for executing upward and downward movement of said wick; and, fuel consumption saving means for driving said wick raising and lowering apparatus to automatically lower said wick from said upper position to a predetermined position which is within a range of combustion positions of said wick after said wick has remained at said upper position for a predetermined time interval.

2. A kerosene heater comprising:

a wick which is movable upward and downward and which can be ignited when raised to an upper position and is extinguished when moved to a lowered position;

a wick raising and lowering apparatus for executing upward and downward movement of said wick; and fuel consumption saving means for driving said wick raising and lowering apparatus to automatically rapidly lower said wick from said upper position to a predetermined position which is within a range of combustion positions of said wick after said wick has remained at said upper position for a predetermined time interval.

3. A kerosene heater comprising:

a wick which is movable upward and downward and which can be ignited when raised to an upper position and is extinguished when moved to a lowered position;

a wick raising and lowering apparatus for executing upward and downward movement of said wick; and fuel consumption saving means for driving said wick raising and lowering apparatus to automatically and gradually lower said wick from said upper position to a predetermined position which is within a range of combustion positions of said wick after said wick has remained at said upper position for a predetermined time interval.

4. A kerosene heater comprising:

a wick which is movable upward and downward and which can be ignited when raised to an upper position and is extinguished when moved to a lowered position;

a wick raising and lowering apparatus for executing upward and downward movement of said wick; and fuel consumption saving means for automatically lowering the wick from said upper position to a predetermined position which is within a range of combustion positions of said wick;

in which said fuel consumption saving means comprises a control circuit which is set to a predetermined condition in response to an operation of raising the wick to said upper position by said wick raising and lowering apparatus, and which subsequently drives the wick raising and lowering apparatus to lower the wick to a predetermined position within said range of combustion positions after a predetermined time interval has elapsed.

5. A kerosene heater according to any of claims 1 through 4 above, in which said fuel consumption saving means further comprises combustion level selection means operable for selecting an arbitrary position within said range of combustion positions to which said wick is automatically lowered by said wick raising and lowering apparatus from said upper position.

6. A kerosene heater according to claim 3, in which said fuel consumption saving means functions to store energy as a result of a wick raising operation by said wick raising and lowering apparatus, and comprises a speed reduction mechanism for applying said energy to drive said wick raising and lowering apparatus to move said wick downward during said operation of automatically lowering the wick.

7. A kerosene heater according to claim 4, in which said fuel consumption saving means comprises electrical drive means controlled by said control circuit for driving said wick raising and lowering apparatus to move said wick downward to said predetermined position within said range of combustion positions after said predetermined time interval has elapsed.

8. A kerosene heater according to any of claims 1-5, further comprising:

means for lowering the wick sufficiently to extinguish the same when the heater is subjected to sudden movement of a predetermined severity.

9. A kerosene heater according to any of claims 1-5, further comprising:

means for rapidly extinguishing said wick upon actuation by a user.

10. A kerosene heater according to any of claims 1-5, wherein:

said combustion level selection means comprises a manual adjustment knob for user-selection of the fuel consumption rate.

11. A kerosene heater according to any of claims 1-5, further comprising:

means for lowering the wick sufficiently to extinguish the same when the heater is subjected to sudden movement of a predetermined severity; and means for rapidly extinguishing said wick upon actuation by a user.

12. A kerosene heater according to any of claim 1-5, further comprising:

means for lowering the wick sufficiently to extinguish the same when the heater is subjected to sudden movement of a predetermined severity; and said combustion level selection means comprises a manual adjustment knob for user-selection of the fuel consumption rate.

* * * * *

UNITED STATES PATENT AND TRADEMARK OFFICE

CERTIFICATE OF CORRECTION

PATENT NO. : 4,872,831

DATED : October 10, 1989

INVENTOR(S) : Masayuki FUJIMOTO, Numeo TAO, Kuniaki UCHIDA

It is certified that error appears in the above-identified patent and that said Letters Patent is hereby corrected as shown below:

Column 10, line 37 should read as follows:

through 3 above, in which said fuel consumption saving

Column 10, line 58 should read as follows:

8. A kerosene heater according to any of claims 1-4,

Column 10, line 63 should read as follows:

9. A kerosene heater according to any of claims 1-4,

Column 10, line 67 should read as follows:

10. A kerosene heater according to any of claims 1-4,

Column 11, line 4 should read as follows:

11. A kerosene heater according to any of claims 1-4,

UNITED STATES PATENT AND TRADEMARK OFFICE

CERTIFICATE OF CORRECTION

PATENT NO. : 4,872,831

DATED : October 10, 1989

INVENTOR(S) : Masayuki Fujimoto, et al

It is certified that error appears in the above-identified patent and that said Letters Patent is hereby corrected as shown below:

Column 12, line 3 should read as follows:

12. A kerosene heater according to any of claims 1-4,

Signed and Sealed this

Twenty-first Day of May, 1991

*Attest:*

HARRY F. MANBECK, JR.

*Attesting Officer*

*Commissioner of Patents and Trademarks*